US007607271B2

(12) United States Patent
Griffin et al.

(10) Patent No.: US 7,607,271 B2
(45) Date of Patent: Oct. 27, 2009

(54) PREFABRICATED MULTI-LAYER ROOFING PANEL AND SYSTEM

(75) Inventors: Christopher J. Griffin, Aurora, CO (US); Bryan Keith Nesti, Hoschton, GA (US); Thomas Justin Stock, Westminster, CO (US)

(73) Assignee: Johns Manville, Denver, CO (US)

( * ) Notice: Subject to any disclaimer, the term of this patent is extended or adjusted under 35 U.S.C. 154(b) by 600 days.

(21) Appl. No.: 10/984,503

(22) Filed: Nov. 9, 2004

(65) Prior Publication Data

US 2006/0096213 A1 May 11, 2006

(51) Int. Cl.
*E04D 1/00* (2006.01)

(52) U.S. Cl. ..... 52/535; 52/478; 52/589.1

(58) Field of Classification Search ..... 52/478, 52/535, 408, 409, 410, 589.1, 590.1–591.5; 428/352, 317.1

See application file for complete search history.

(56) References Cited

U.S. PATENT DOCUMENTS

| | | | | | |
|---|---|---|---|---|---|
| 3,111,787 | A | | 11/1963 | Chamberlain | |
| 3,138,251 | A | * | 6/1964 | Olszyk et. al. | 206/324 |
| 3,223,576 | A | * | 12/1965 | Evans et. al. | 428/218 |
| 3,468,086 | A | | 9/1969 | Warner | |
| 3,763,614 | A | * | 10/1973 | Hyde et al. | 52/309.9 |
| 4,021,981 | A | * | 5/1977 | Van Wagoner | 52/309.13 |
| 4,351,138 | A | * | 9/1982 | McMillan et al. | 52/309.4 |
| 4,357,377 | A | * | 11/1982 | Yamamoto | 428/40.3 |
| 4,450,663 | A | * | 5/1984 | Watkins | 52/309.4 |
| 4,469,731 | A | * | 9/1984 | Saracino | 428/68 |
| 4,670,071 | A | * | 6/1987 | Cooper et al. | 156/71 |
| 4,677,800 | A | * | 7/1987 | Roodvoets | 52/309.12 |
| 4,680,909 | A | | 7/1987 | Stewart | |
| 4,706,435 | A | | 11/1987 | Stewart | |
| 4,726,973 | A | * | 2/1988 | Thompson | 428/45 |
| 4,936,070 | A | * | 6/1990 | Michaud | 52/40 |
| 4,965,977 | A | | 10/1990 | White | |
| 4,992,315 | A | * | 2/1991 | Zickell et al. | 428/40.3 |
| 4,996,803 | A | * | 3/1991 | Karrfalt et al. | 52/96 |
| 5,069,950 | A | * | 12/1991 | Crookston, Sr. | 428/156 |
| 5,251,416 | A | | 10/1993 | White | |
| 5,373,674 | A | * | 12/1994 | Winter, IV | 52/309.9 |
| 5,394,672 | A | * | 3/1995 | Seem | 52/794.1 |
| 2002/0155274 | A1 | * | 10/2002 | Ramesh et al. | 428/317.1 |
| 2002/0155305 | A1 | * | 10/2002 | Peuramaki | 428/458 |
| 2004/0200154 | A1 | * | 10/2004 | Hunter, Jr. | 52/90.1 |
| 2004/0226247 | A1 | * | 11/2004 | Byrd | 52/518 |
| 2005/0144850 | A1 | * | 7/2005 | Hageman | 52/3 |

* cited by examiner

*Primary Examiner*—Richard E Chilcot, Jr.
*Assistant Examiner*—Anthony N Bartosik
(74) *Attorney, Agent, or Firm*—Robert D. Touslee

(57) ABSTRACT

A prefabricated multi-layer roofing panel is utilized in a roofing system for low-slope roofs. The prefabricated roofing panel includes: an insulation layer that may have a self-adhering means on its bottom major surface for securing the roofing panel to a roofing substrate; a cover board that overlies and is bonded to the insulation layer, and a waterproofing membrane that overlies and is bonded to the cover board. The waterproofing membrane may have waterproofing membrane overlaps for overlapping and being bonded to the waterproofing membranes of other roofing panels in the formation of a roofing system. Preferably, the insulation layer includes interlocking structure for interlocking the prefabricated multi-layer roofing panels together in the roofing system.

4 Claims, 2 Drawing Sheets

PREFABRICATED MULTI-LAYER ROOFING PANEL AND SYSTEM

BACKGROUND OF THE INVENTION

The subject invention relates to low-slope roofs that are typically found on commercial and industrial buildings and in particular, to prefabricated multi-layer roofing panels and a roofing system for low-slope roofs.

Commercial and industrial buildings typically have roofs with low-slope roof decks. The roofing systems for roofs with low-slope roof decks typically include one or more layers of low-density insulation, such as low-density polymer-based foam insulation layer, that, if not protected, can be partially crushed or otherwise damaged from worker traffic over the insulation, the placement of heaving objects on the insulation, the weather, and other causes commonly encountered in roofing construction; a layer of roofing cover boards that overlie and protect the more fragile low-density insulation from damage, act as fire barriers, and augment the insulating function of the low-density insulation; and an uppermost layer that is a waterproofing membrane. Normally, these three components (the low-density insulation, the roofing cover boards, and the waterproofing membrane) of the roofing system are separately manufactured and separately and successively applied to the low-slope roof deck. These roofing systems function very well and there are multi-layer roofing panels such as the roofing panels disclosed in U.S. Pat. Nos. 3,111,787; 3,468,086; 4,680,909; 4,706,435; 4,965,977; and 5,251,416 for use in roofing systems. However, there has remained a need for an improved prefabricated multi-layer roofing panel: that combines the insulation layer, the roofing cover board layer, and the waterproofing membrane layer into a single unit; that can be effectively, easily, and quickly self-adhered to a roof substrate; that has a waterproofing membrane which can be effectively, easily and quickly joined to the membranes of other roofing panels to form a waterproofing membrane for the roofing system; and/or that includes an interlocking structure for effectively, easily, and quickly locking together the roofing panels of the roofing system. With the use of such an improved prefabricated multi-layer roofing panel, roofing systems for low-slope roof decks can be improved and/or the time, labor and costs associated with the installation of roofing systems on low-slope roof decks can be reduced. In addition, the assembly of the prefabricated multi-layer roofing panels under controlled factory conditions greatly reduces the possibility of defects in the roofing system.

SUMMARY OF THE INVENTION

The improved prefabricated multi-layer roofing panel of the subject invention and the improved roofing system of the subject invention for low-slope roofs fulfill the needs discussed immediately above. The prefabricated multi-layer roofing panel of the subject invention includes: an insulation layer; a cover board that overlies and is bonded to the insulation layer, and a waterproofing membrane that overlies and is bonded to the cover board.

For certain applications, the prefabricated multi-layer roofing panel of the subject invention has a self-adhering adhesive on its bottom major surface (the bottom major surface of the insulation layer) for effectively, easily, and quickly securing the prefabricated multi-layer roofing panel to an underlying roofing substrate without the need to penetrate the underlying roofing substrate with mechanical fasteners. For example, where the underlying roofing substrate is a cementitious roof deck or roofing insulation layer, the prefabricated multi-layer roofing panel of the subject invention can be adhesively attached to the cementitious deck or insulation layer without using mechanical fasteners and still meet Factory Mutual wind uplift standards. These self-adhering adhesives are typically water-based adhesives, solvent-based adhesives, or other commonly available self-adhering adhesives that will stick and bond the panel to the surface of the underlying roofing layer. For other applications, such as where the prefabricated multi-layer roofing panel is being secured directly to a steel roof deck, the panel must be secured by other means, e.g. mechanical fasteners, to meet Factory Mutual wind uplift standards and the self-adhering adhesive can be eliminated from the bottom major surface of the prefabricated multi-layer roofing panel.

The insulation layer of the prefabricated multi-layer roofing panel of the subject invention may include an overlapping interlocking structure for effectively, easily, and quickly interlocking the prefabricated multi-layer roofing panel with other roofing panels in a roofing system to provide the roofing system with increased structural integrity. Where the insulation layer of the panel is susceptible to shrinkage after application, the overlapping interlocking structure also accommodates the shrinkage of the insulation layer without creating thermal channels between adjacent panels in the roofing system that could reduce the overall insulating properties of the system.

Preferably, the waterproofing membrane of the prefabricated multi-layer roofing panel of the subject invention has waterproofing membrane overlaps that can be effectively, easily, and quickly placed over and bonded to the waterproofing membranes of other roofing panels in the system to form a waterproofing membrane for the panels as the panels are installed. Thus, as the prefabricated multi-layer roofing panels of the subject invention are installed in a roofing system, a waterproofing membrane can be formed that protects the cover board and insulation layers of the panel from moisture and other climatic conditions that could adversely affect the cover board and/or insulation layers.

In a preferred embodiment of the prefabricated multi-layer roofing panel of the subject invention, the insulation layer has a low-density polymer or predominantly polymer material foam core layer having a density less than 6 lbs/ft$^3$ and a thickness between about 0.50 inches and about 6 inches and the cover board layer of the prefabricated multi-layer roofing panel has a high density polymer or predominantly polymer material core layer having a density between 6 lbs/ft$^3$ and 25 lbs/ft$^3$ and a thickness of about 0.08 inches or greater. The thickness and density of the insulation layer are selected to provide the prefabricated multi-layer roofing panel of the subject invention with the insulating characteristics required for the application. The density and thickness of the high-density predominantly polymer material core layer of the cover board of the prefabricated multi-layer roofing panel of the subject invention are selected: to provide the cover board with the compressive strength to resist deformation, to protect the low-density insulation layer overlaid by the cover board from damage, and to provide the core layer of the cover board with surface characteristics that promote the bonding of the waterproofing membrane to the top major surface of core layer. The prefabricated multi-layer roofing panel of the subject invention with its high-density polymer or predominantly polymer material cover board and low-density polymer or predominantly polymer material foam insulation layer is relatively lightweight and easy to handle and, when needed, can be easily cut to make the prefabricated multi-layer roofing panel easier to install and increase the productivity of workers installing a roofing system using the prefabricated multi-layer roofing panels.

DESCRIPTION OF THE PREFERRED EMBODIMENTS

Figure 1:
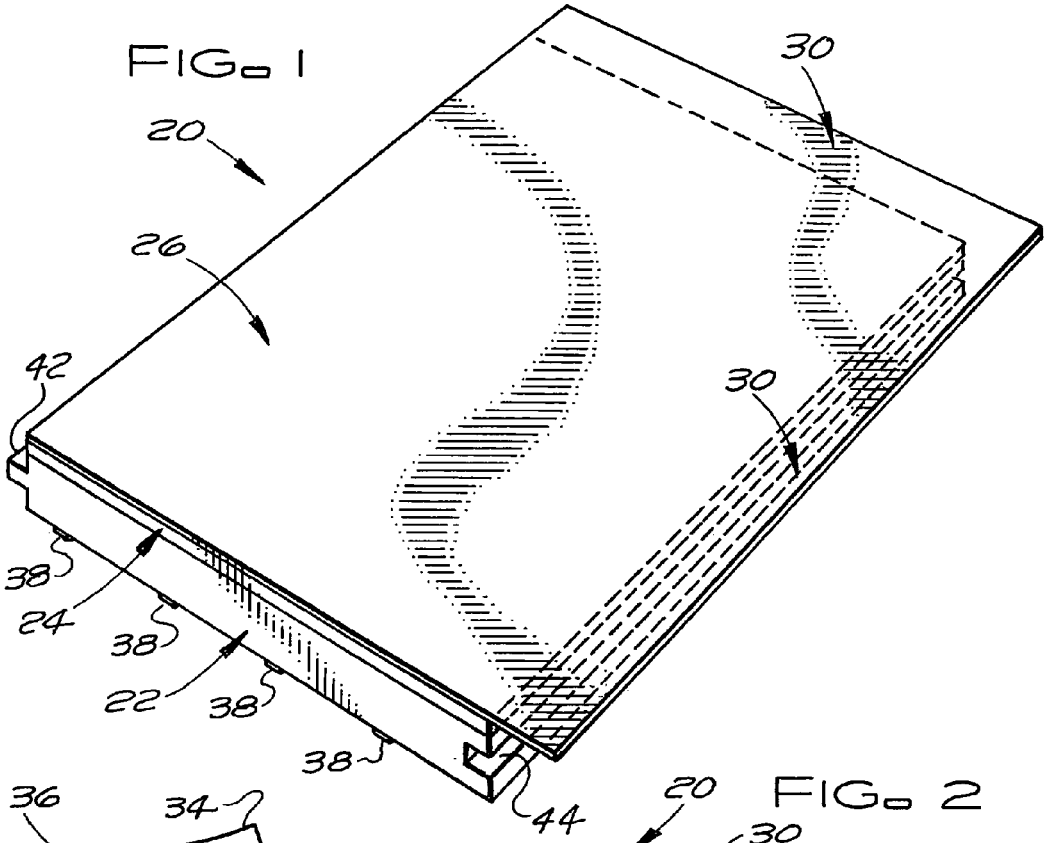
FIG. 1 is a schematic perspective view of a multi-layer prefabricated roofing panel of the subject invention.
Figure 2:
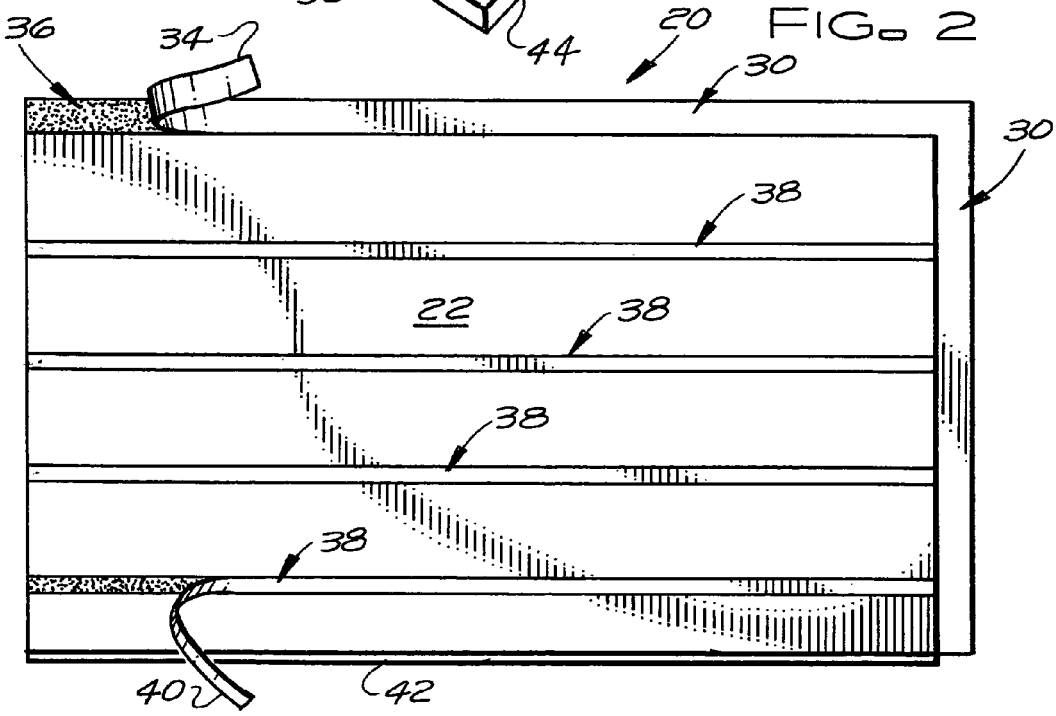
FIG. 2 is a schematic bottom view of the multi-layer prefabricated roofing panel of FIG. 1 showing self-adhering strips for bonding the multi-layer prefabricated roofing panel to a roof substrate.

As shown in FIGS. 1 and 2, the prefabricated multi-layer roofing panel 20 of the subject invention includes an insulation layer 22, a cover board 24, and a waterproofing membrane 26. The prefabricated multi-layer roofing panel 20 typically has a width of about four feet or greater and a length of about four feet or greater, preferably, about eight feet or greater and could have lengths that are limited only by the ability to store, transport and handle the roofing panel composites prior to installation, e.g. lengths equal to the 53 foot long bed length of a flatbed truck.

The insulation layer 22 has a low-density core layer with top and bottom major surfaces that are each defined by the length and the width of the insulation layer. The insulation layer 22 has a first pair of edges that are each defined by the length and the thickness of the insulation layer and a second pair of edges that are each defined by the width and the thickness of the insulation layer. The low-density core of the insulation layer 22 is typically between about 0.50 inches and about 6 inches in thickness and has a density of less than 6 lbs/ft$^3$, preferably less than 4 lbs/ft$^3$ and typically between about 1 lbs/ft$^3$ and about 3 lbs/ft$^3$. The low-density core of the insulation layer 22 may be made of conventional roofing insulations, such as but not limited to low-density polymer or predominantly polymer material foam insulations [e.g. low-density polyisocyanuate, polyurethane, polystyrene, and phenolic material foam insulations and low-density foam insulations made of blends thereof; low-density predominantly polyisocyanurate, polyurethane, polystyrene, and phenolic material foam insulations with inorganic filler(s) and low-density foam insulations made of blends thereof; other low-density foams made of thermoset matrix polymers, etc.], fiberglass insulations or a composite of two or more of these materials. The low-density core layer of the insulation layer 22 may have no facings, an upper facer overlying and bonded to the top major surface of the low-density core layer, and/or a bottom facer overlying and bonded to the bottom major surface of the low-density core layer. When a top facer is used on the low-density core layer of the insulation core 22, the top facer may be any sheet material with good bonding surfaces that facilitates a good bond between the insulation layer 22 and the cover board 24, such as but not limited to paper, woven or nonwoven mats made of glass and/or polymeric fibers, other fibers or filaments, scrims, etc. When a bottom facer is used on the low-density core layer of the insulation layer 22, the bottom facer may be any sheet material that provides a suitable bottom surface for the insulation layer 22 and the prefabricated multi-layer roofing panel 20, such as but not limited to paper, woven or nonwoven mats made of glass and/or polymeric fibers, other fibers or filaments, scrims, and composites of two or more of these sheet materials.

The cover board 24 has a high-density core layer with a length and width that are equal to or substantially equal to the length and the width of low-density core layer of the insulation layer 22. The cover board 24 has top and bottom major surfaces that are each defined by the length and the width of the cover board. The cover board 24 has a first pair of edges that are each defined by the length and thickness of the cover board and a second pair of edges that are each defined by the width and thickness of the cover board. The cover board 26 overlies the top major surface of the insulation layer 22 and has its bottom major surface, which is coextensive with or substantially coextensive with the top major surface of the insulation layer 24, bonded to the top major surface of the insulation layer 22. The high-density core layer of the cover board is typically between about 0.08 inches and about 0.75 inches in thickness; typically has a density between 6 lbs/ft$^3$ and 25 lbs/ft$^3$. The high-density core layer of the cover board may be made of various board materials that will resist deformation and protect the insulation layer 22 from damage, such as but not limited to a high-density polymer or predominantly polymer material board [e.g. a high-density polyisocyanurate, polyurethane, polystyrene, or phenolic material board or a high-density board made of a blend of these materials; a high-density polyisocyanurate, polyurethane, polystyrene, or phenolic material foam board or a high-density foam board made of a blend of these materials; a high-density predominantly polyisocyanurate, polyurethane, polystyrene, or phenolic material board with inorganic filler(s) or a high-density board made of a blend of these materials with filler(s); a high-density predominantly polyisocyanurate, polyurethane, polystyrene, or phenolic material foam board with inorganic filler(s) or a high-density foam board made of a blend of these materials with filler(s), a high-density board made of other thermoset matrix polymers; etc.], a perlite board, a wood fiber board, a gypsum board, or a composite of two or more of these board materials. The bottom major surface of the high-density core layer of the cover board 24 may have no facer or a bottom facer overlying and bonded to the bottom major surface of the high-density core layer. Where there is a bottom facer, the facer can function as a common facer for the bottom of the cover board 24 and the top of the insulation layer 22. When a bottom facer is used on the high-density core layer of the cover board 22, the bottom facer may be any sheet material with good bonding surfaces that facilitates a good bond between the insulation layer 22 and the cover board 24, such as but not limited to paper, woven or nonwoven mats made of glass and/or polymeric fibers, other fibers or filaments, scrims, etc.

The waterproofing membrane 26 forms the top facer on the high-density core layer of the cover board 24 and thus, the top facer of the prefabricated multi-layer roofing panel 20. The waterproofing membrane 26 has top and bottom major surfaces that are each defined by the length and the width of the waterproofing membrane. The waterproofing membrane 26: overlies the top major surface of the cover board 24, has its bottom major surface bonded to the top major surface the cover board 24, and, preferably, extends beyond the top major surface of the cover board 24 along one of the first pairs of edges and along one of the second pairs of edges of the cover board to form waterproofing membrane overlaps 30. The waterproofing membrane overlaps 30 are typically about 3 to 5 inches wide and extend along one side and one end of the prefabricated multi-layer roofing panel 20. The waterproofing membrane 26 may be any of a number of waterproofing roofing membranes such as but not limited to bituminous waterproofing membranes, modified bituminous roofing membranes, self-adhering roofing membranes, or single ply waterproofing roofing membranes (e.g. EPDM waterproofing roofing membranes, PVC waterproofing roofing membranes, TPO waterproofing roofing membranes).

Figure 3:
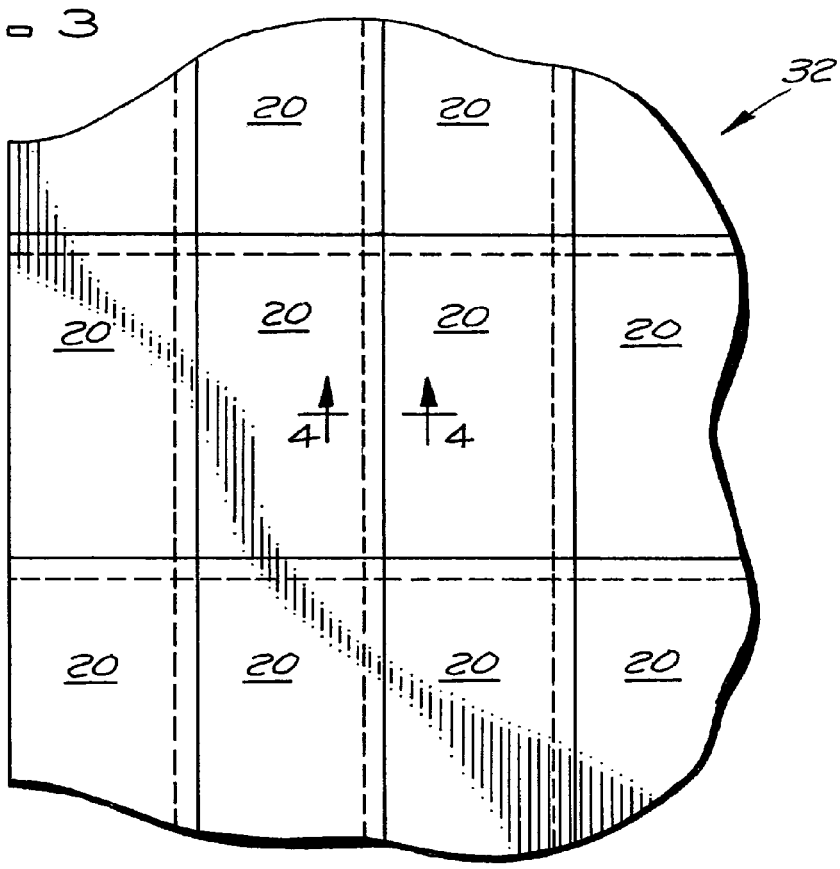
FIG. 3 is a schematic plan view of a portion of a low-slope roof with a roofing system that utilizes the prefabricated multi-layer roofing panel of the subject invention.
Figure 4:
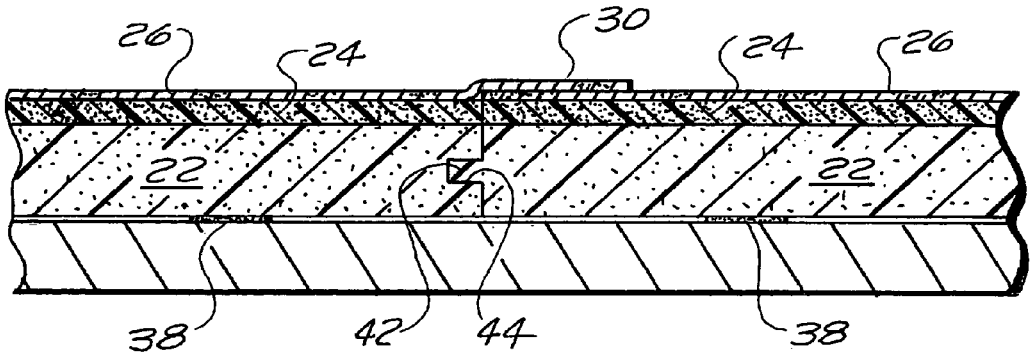
FIG. 4 is a schematic transverse cross section, taken substantially along lines 4-4 of FIG. 3 and on a larger scale than FIG. 3, through a joint between two of the prefabricated multi-layer roofing panels of the roofing system.

As shown in FIGS. 3 and 4, when the prefabricated multi-layer roofing panel 20 is installed in a roofing system 32, the waterproofing membrane overlaps 30 of the panel 20 overlap and are bonded to the edge portions of the membranes 26 of other of the prefabricated multi-layer roofing panels 20 in the roofing system 32. The overlapping seams formed between the overlaps 30 and the top surfaces of the edge portions of the waterproofing membranes of these other prefabricated multi-layer roofing panels 20 are watertight. The waterproofing membrane overlaps 30 of the prefabricated multi-layer roofing panel 20 may be bonded to the waterproofing membranes 26 of other of the prefabricated multi-layer roofing panels in the roofing system 32 by various methods such as but not limited: to applying hot asphalt between the bottom surfaces of the overlaps 30 and the top surfaces of the edge portions of the waterproofing membranes of the other panels; by torching the overlaps 30 and the top surfaces of the edge portions of the waterproofing membranes of the other panels when using appropriate modified bituminous membranes; by using roofing adhesives other than asphalt or adhesive tapes between the bottom surfaces of the overlaps 30 and the top surfaces of the edge portions of the waterproofing membranes of the other panels; by heat welding techniques when using appropriate thermosetting single ply membranes (e.g. PVC membranes, TPO membranes); by microwave heating techniques, and by applying a self-adhering asphalt or other adhesive between the bottom surfaces of the overlaps 30 and the top surfaces of the edge portions of the waterproofing membranes of the other panels.

In one preferred embodiment of the prefabricated multi-layer roofing panel of the subject invention, the waterproofing membrane 26 is a self-adhering membrane with a self-adhering adhesive top major surface that is overlaid by a release liner and self-adhering adhesive overlaps 30 that have bottom surfaces overlaid by release liners or a membrane with self-adhering overlaps 30 that have bottom self-adhering adhesive surfaces overlaid by release liners. The overlaps 30 of this self-adhering membrane are bonded to the self-adhering membranes 26 of other of the prefabricated multi-layer roofing panels in the roofing system 32 by the self-adhering adhesive of the membranes that forms watertight overlapping seams between the membranes. FIG. 2 shows a waterproofing membrane 26, which is a self-adhering membrane. In FIG. 2, a release liner 34 is partially peeled back to expose the self-adhering adhesive 36 of the membrane overlaps 30. In this specification and claims, a self-adhering adhesive includes but is not limited to self-adhering asphalt-based adhesives and is an adhesive that will bond two surfaces together, primarily with the application of pressure, and that forms an effective bond for roofing applications between the surfaces without the need to use heat, flame, an additional adhesive material, or hot asphalt material.

In a preferred embodiment of the subject invention, the bottom major surface of the insulation layer 22 and thus, the prefabricated multi-layer roofing panel 20 has a self-adhering adhesive thereon for adhering the prefabricated multi-layer roofing panel to a roofing substrate. These self-adhering adhesives are typically water-based adhesives, solvent-based adhesives, or other commonly available self-adhering adhesives that will stick and bond the panel to the surface of the underlying roofing layer. The self-adhering adhesive may be in the form of a plurality of spaced-apart self-adhering adhesive strips 38 that are applied to the bottom major surface of the insulation layer 22. The self-adhering adhesive strips may be continuous along their lengths or discontinuous along their lengths (dashed or dotted adhesive strips). In one embodiment, each self-adhering adhesive strip 38 is overlaid with a separate release liner strip 40, one of which is shown partially peeled back in FIG. 2. In another embodiment, not shown, the plurality of spaced-apart self-adhering adhesive strips 38 are overlaid by a common release liner sheet so that the removal of the one release liner sheet exposes all of the self-adhering adhesive strips 38 prior to the application of the prefabricated roofing panel 20 to a roofing substrate. In another embodiment, the self-adhering adhesive may be a self-adhering adhesive coating that covers the entire or substantially the entire bottom major surface of the insulation layer 22 or a pattern or random pattern of self-adhering adhesive on the bottom major surface of the insulation layer 22 that is coextensive with or substantially coextensive with the bottom major surface of the insulation layer 22. In this embodiment, a common release liner overlies the self-adhering adhesive coating, pattern, or random pattern utilized on the bottom major surface of the insulation layer 22. The release liner strip or sheet materials may be any of the release liner materials commonly used for such purposes, such as but not limited to silicone treated sheet materials.

At least one of the pairs of insulation layer edges can have interlocking structures for interlocking the insulation layer 22 of the prefabricated multi-layer roofing panel 20 with the insulation layers 22 of other of the prefabricated multi-layer roofing panels in the roofing system 32. Preferably, the pair of insulation layer edges is the pair of edges wherein the edges are each defined by the length and thickness of the insulation layer 22. Both pairs of insulation layer edges could have interlocking structures for interlocking the insulation layer 22 of the prefabricated multi-layer roofing panel 20 with insulation layers 22 of other of the prefabricated multi-layer roofing panels in the roofing system 32. Various interlocking structures may be used such as but not limited to ship lap joints and complementary beveled surface joints. However, a preferred interlocking structure is a tongue 42 and groove 44 interlocking structure such as the interlocking structure shown in FIGS. 1 and 4 that provides a better interlock between the prefabricated multi-layer roofing panels 20 and better eliminates the creation of thermal channels between prefabricated multi-layer roofing panels 20 even when there is shrinkage of the insulation layer after installation. Where a tongue and groove interlocking structure is used, the tongue and groove elements may be coated with a thin layer of high-density polymer-based material to reduce friability and increase the integrity of the elements.

In a preferred embodiment of the prefabricated multi-layer roofing panel 20, the insulation layer 22 is or has a low-density polyisocyanurate or predominantly polyisocyanurate material foam core layer and the cover board 24 is or has a high-density polyisocyanurate or predominantly polyisocyanurate material core layer. The low-density foam core layer of the insulation layer 22 has a density less than 6 lbs/ft$^3$, preferably less than 4 lbs/ft$^3$, and typically between about 1 lbs/ft$^3$ and about 3 lbs/ft$^3$. The low-density foam core layer of the insulation layer 22 has a thickness of about 0.50 inches or greater and, typically, a thickness between about 0.50 inches and about 6 inches. The density and thickness of the low-density foam core layer of the insulation layer 22 are selected to provide the prefabricated multi-layer roofing panel 20 with the desired insulating properties for the roofing system application. The high-density core layer of the cover board 24 has a density between 6 lbs/ft$^3$ and 25 lbs/ft$^3$ and preferably a density of at least 8 lbs/ft$^3$. The high-density core layer of the cover board 24 has a thickness of about 0.08 inches or greater and, preferably, a thickness between about 0.08 inches and about 0.75 inches. The precursors of the low-density core layer of the insulation layer 22 and the high-density core layer of the cover board 24 may contain various powdered and liquid fillers to reduce the cost and/or modify the properties of the core layers (such as but not limited to the compressive strength, the flexibility, the toughness, the friability, the fire resistance of the core layer). Examples of fillers that may be used in the precursors for the low-density and high-density core layers of the insulation layer 22 and the cover board 24 are fillers such as but not limited to limestone ($CaCO_3$), fiberglass, recycled polyisocyanurate dust, and extenders/plasticizers (e.g., Vycel U™).

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A roofing system for a low-slope roof, comprising:

a low-slope roof deck substrate overlaid by a plurality of prefabricated multi-layer roofing panels; the prefabricated multi-layer roofing panels being secured to the substrate; and the prefabricated multi-layer roofing panels each comprising:

an insulation layer; the insulation layer being a low-density predominantly polymer material foam layer having a density less than 6 lbs/ft$^3$ and a thickness between about 0.50 inches and about 6 inches; the insulation layer having a length, a width, and a thickness; the insulation layer having a top major surface and a bottom major surface that are each defined by the length and the width of the insulation layer; the insulation layer having a first pair of edges that are each defined by the length and the thickness of the insulation layer; the insulation layer having a second pair of edges that are each defined by the width and the thickness of the insulation layer; the bottom major surface of the insulation layer forming the bottom surface of the prefabricated multi-layer roofing panel and having self adhering adhesive thereon for adhering the prefabricated multi-layer roofing panel to the roofing substrate;

a cover board; the cover board being a high density predominantly polymer material layer having a density between 6 lbs/ft$^3$ and 25 lbs/ft$^3$ and a thickness between about 0.08 inches and 0.75 inches; the cover board having a length, a width, and a thickness; the length and the width of the cover board being substantially equal to the length and the width of the insulation layer; the cover board having a top major surface and a bottom major surface that are each defined by the length and the width of the cover board; the cover board having a first pair of edges that are each defined by the length and the thickness of the cover board; the cover board having a second pair of edges that are each defined by the width and the thickness of the cover board;

a waterproofing membrane; the waterproofing membrane having a length and a width; the waterproofing membrane having a top major surface and a bottom major surface that are each defined by the length and the width of the waterproofing membrane; the waterproofing membrane overlying the top major surface of the cover board and being bonded to the top major surface the cover board; and the prefabricated multi-layer roofing panels being bonded to the low-slope deck substrate by the self-adhering adhesive on the bottom major surface of the insulation layer of the prefabricated multi-layer roofing panel.

2. The roofing system for a low-slope roof according to claim 1, wherein:

the insulation layer is a low-density predominantly polymer material foam layer with inorganic filler; and the cover board is a high-density predominantly polymer material layer with inorganic filler.

3. The roofing system for a low-slope roof according to claim 1, wherein:

the waterproofing membrane extends beyond the top major surface of the cover board along one of the first pairs of edges and along one of the second pairs of edges of the cover board to form waterproofing membrane overlaps for overlapping and being bonded to the waterproofing membranes of other of the prefabricated multi-layer roofing panels in the formation of a roofing system; and the waterproofing membrane overlaps of each prefabricated multi-layer roofing panel overlap and are bonded to the waterproofing membranes of other of the prefabricated multi-layer roofing panels in the roofing system.

4. The roofing system for a low-slope roof according to claim 3, wherein:

at least one of the pairs of insulation layer edges of each of the prefabricated multi-layer roofing panels have interlocking means for interlocking the insulation layer of the prefabricated multi-layer roofing panel with the insulation layers of other of the plurality of prefabricated multi-layer roofing panels and each of the prefabricated multi-layer roofing panels are interlocked by the interlocking means to other of the plurality prefabricated multi-layer roofing panels in the roofing system.

* * * * *